US006065890A

United States Patent [19]

Weitz

[11] Patent Number: 6,065,890

[45] Date of Patent: May 23, 2000

[54] CLEANING APPARATUS PROVIDING COINCIDENTAL WASHING AND WIPING IN A SYNCHRONIZED MANNER

[76] Inventor: Gene C. Weitz, 5498 Worthington Loop, Palm Harbor, Fla. 34685

[21] Appl. No.: 09/131,627

[22] Filed: Aug. 10, 1998

Related U.S. Application Data

[63] Continuation-in-part of application No. 08/811,448, Mar. 3, 1997, abandoned.

[51] Int. Cl.[7] ..... B43K 5/02

[52] U.S. Cl. ..... 401/146; 401/22; 401/23; 401/37; 401/25

[58] Field of Search ..... 401/22, 23, 37, 401/146, 203, 204, 25

[56] References Cited

U.S. PATENT DOCUMENTS

| | | | |
|---|---|---|---|
| 1,459,071 | 6/1923 | Muman | 401/203 |
| 1,977,483 | 10/1934 | Koukal | 401/37 |
| 3,118,166 | 1/1964 | Bell | 401/25 |
| 3,783,469 | 1/1974 | Siemund | 15/209 R |
| 5,165,811 | 11/1992 | MacLeod | 401/37 X |
| 5,536,095 | 7/1996 | Diamond | 401/23 X |

*Primary Examiner*—David J. Walczak
*Attorney, Agent, or Firm*—Dennis L. Cook

[57] ABSTRACT

An improved self-contained cleaning apparatus which has a washing element and a wiping element situated in a coincidentally spaced relation to one another such that a surface is cleaned by synchronized washing and wiping.

5 Claims, 2 Drawing Sheets

CLEANING APPARATUS PROVIDING COINCIDENTAL WASHING AND WIPING IN A SYNCHRONIZED MANNER

RELATED APPLICATION

This application is a continuation-in-part of U.S. patent application Ser. No. 08/811,448 filed Mar. 3, 1997 now abandoned.

BACKGROUND OF THE INVENTION

1. Field of the Invention

This invention relates, generally, to an improved cleaning apparatus for cleaning surfaces. More particularly, it relates to an improved self-contained cleaning apparatus which has a washing element and a wiping element situated in a coincidentally spaced relation to one another such that a surface is cleaned by synchronized washing and wiping.

2. Description of Related Art

Numerous cleaning devices have been developed over the years. However, all of these prior art devices have various shortcomings. For example, devices such as those disclosed in U.S. Pat. Nos. 5,469,594; 4,312,093; and 2,446,401 have a washing element and a wiping or squeegee element. The washing element is wetted by an external source of water or cleaning solution. Wetting can be accomplished in a number of ways, including, submersion in a source of liquid or wetting with a source of flowing water. The necessity of wetting the washing element makes these devices inconvenient to use and requires the use of additional equipment such as buckets and/or hoses.

Other cleaning devices, including those disclosed in U.S. Pat. Nos. 4,871,275; 3,549,265; 2,893,044; 2,746,071; 2,741,788; and Australian Patent No. 45,277/68, have a washing element, a wiping or squeegee element and an attachment means for attachment to an external water or cleaning solution source. The use of these cleaning devices is limited by the range of motion allowed by the length of tubing from the device to the external water or cleaning solution source. Further, the numerous connectors and hose junctions required for these devices to work limits their utility due to water leakage and loss of pressure during use.

Other cleaning devices, such as those disclosed in U.S. Pat. Nos. 5,364,198; 4,778,301; and 2,037,349, have a liquid reservoir which is part of the device. These devices deliver liquid to a surface to be cleaned. Use of these devices oftentimes results in undesirable liquid consumption due to puddling and waste.

Still other cleaning devices, such as those disclosed in U.S. Pat. Nos. 5,536,095; 5,054,945; 4,944,623; 3,837,747; 3,721,502; 3,118,166; 2,595,687; 2,722,701; 1,984,370; and 1,383,731, have a liquid reservoir which is part of the device for delivering liquid to a washing element and, with the exception of the devices disclosed in U.S. Pat. Nos. 2,595,687 and 1,383,731, also have a wiping or squeegee element. Delivery of liquid to the washing elements of these devices can be problematic due to the complicated mechanics of many of the delivery means. In addition, none of these devices provide a means for synchronized washing and wiping of the surface being cleaned. The '166 patent teaches a device in which the liquid is continuously pumped through a center aperture directly to a surface being cleaned. The washing element of the '166 patent washing and wiping of the surface being cleaned is disclosed. The inventive cleaning apparatus has a hollow elongate tubular handle, which is also a liquid reservoir. The tubular handle has a manually operated liquid delivery means for delivering liquid to the washing element through a liquid distribution means enclosed within the washing element. The tubular handle typically threads into a housing in a fluid tight and releasable engagement. The housing contains a liquid delivery means such as a manually-operated pump which generally operates by squeezing a handle or pushing a button. On the discharge side of the housing which includes the pump is a support portion which holds the washing element and the wiping element. The washing and the wiping elements are oriented on the same side in an angular spaced relationship wherein each element is attached to a respective first and second portions of the support portion, the first and second portions merging with a base portion of the support portion to form a Y-shape configuration. The washing element extends horizontally across and beyond the first portion of the support portion and is in fluid communication with the liquid distribution means which is in fluid communication with the liquid delivery means and the liquid reservoir in the handle.

Fluid communication is typically accomplished with tubes and fittings wherein the liquid distribution means is typically a tee with perforated tubes extending in both directions within the washing element. A tube is connected to the tee and extends within the support portion to the discharge connection on the manually operated liquid delivery means or pump. In turn, a tube does not apply the liquid to the surface being cleaned. Further, there is no conservation of cleaning fluid as obtained by the controlled application and wiping of the present invention.

Russian Patent 456608 does include same-side mounting of washing and wiping elements; however, it too lacks the structured elements which allow a uniform controlled application, removal and reuse of cleaning fluid as embodied within the present invention. Fluid is dispersed directly to a surface to be cleaned from the perforations on both sides of a stiffness rib. The Russian patent does not solve the problem of conserving fluid by teaching a device where fluid can be applied as needed, wiped off, and recollected within the washing element by synchronous motion of the device as taught by the present invention.

Thus, what is needed then is a cleaning apparatus having a self-contained liquid reservoir, a washing element and a wiping element, in which liquid is delivered to the washing element in a controlled and uniform manner and the washing and wiping elements are situated in a coincidentally spaced relation to one another such that a surface is cleaned by synchronous washing and wiping.

In view of the prior art as a whole at the time the present invention was made, it was not obvious to those of ordinary skill in the pertinent art how the needed cleaning apparatus could be provided.

SUMMARY OF THE INVENTION

In accordance with the present invention, a self-contained cleaning apparatus which has a liquid reservoir, a washing element, and a wiping element and provides for synchronous is connected from the suction side of the liquid delivery means or pump and extends into the reservoir.

The wiping element is secured to the second portion of the support portion, is parallel to the washing element and extends horizontally across the washing element. The washing and wiping elements are disposed in an angular spaced relation to one another such that when the washing element is positioned in effective relation to a surface to be cleaned the wiping element is coincidentally positioned in effective relation to that same surface. This novel design provides that the surface is synchronously washed and wiped in one movement. Another object of the present invention is conservation. The inherent characteristic of this novel invention allows an operator to reuse the same fluid in each stroke as any dispensed fluid on a cleaning surface which is coincidentally wiped is reabsorbed by the sponge washing element by a subsequent forward motion of the device on the surface to be cleaned. Thus, the washing element is ready to reapply the same cleaning fluid on the subsequent backward motion of the device. The cycle is repeated until the washing element is ready for a recharge. Therefore, only a one time or as needed charge to saturate the washing element is required. The recharge generally occurs prior to starting at the top of a new surface.

The invention accordingly comprises the features of construction, combination of elements and arrangement of parts that will be exemplified in the description hereinafter set forth, and the scope of the invention will be indicated in the claims.

BRIEF DESCRIPTION OF THE DRAWINGS

For a fuller understanding of the nature of the invention, reference should be made to the following detailed description, taken in connection with the accompanying drawings, in which.

DETAILED DESCRIPTION OF THE INVENTION

Figure 1:
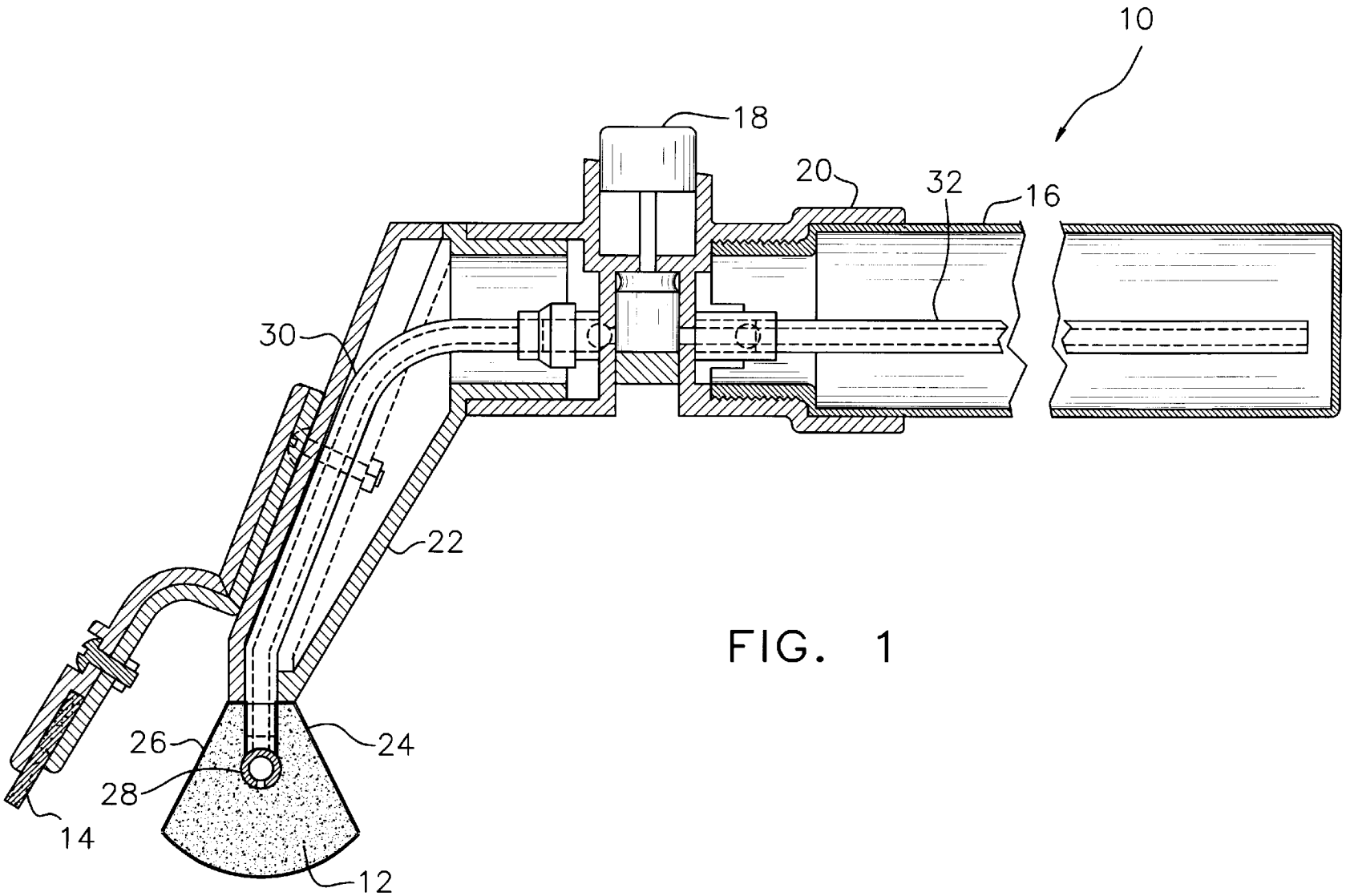
FIG. 1 is a cross-sectional view of a cleaning apparatus of the present invention.
Figure 2:
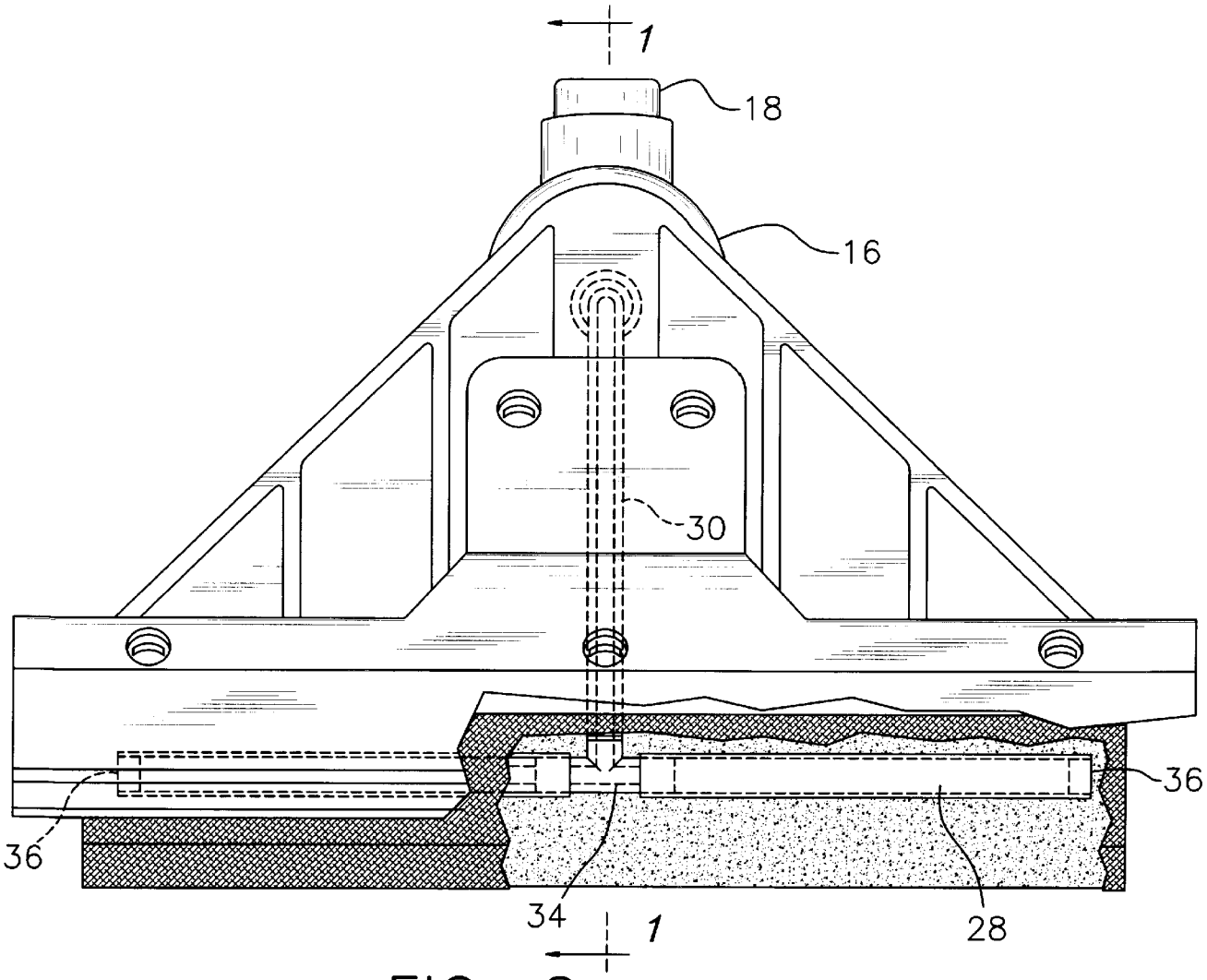
FIG. 2 is a side view of the cleaning apparatus shown in FIG. 1.

Referring now to the drawings, in which like numerals refer to like elements thereof, FIG. 1 and FIG. 2, show the novel cleaning apparatus of the present invention which is denoted as a whole by the reference numeral 10. The cleaning apparatus 10 has a tubular handle 16 which functions as a liquid reservoir; a washing element 12; a wiping element 14; a liquid delivery means 18 which is contained in a housing portion 20; a support portion 22 with branching first and second portions to form a Y-shape configuration, the washing element 12 being attached to the first portion and the wiping element 14 being attached to the second portion; and a liquid distribution means 28 enclosed within the washing element 12 wherein the liquid distribution means 28 is capable of dispensing fluid in a uniform manner within the washing element 12.

The tubular handle 16 functions as a liquid reservoir and is fabricated of any suitable lightweight material. For example, the reservoir may be molded from polyethylene. Suitable handle dimensions include any convenient diameter and length, provided the handle can be held in one hand and is not unwieldy to use. For example, diameters of from 1 to 12 inches, and lengths of from 5 to 36 inches, are contemplated. Preferably the handle has a diameter of from 1.5 to 8 inches and a length of from 7 to 18 inches. Typically, the handle has a diameter of about 2 inches and a length of about 10 inches.

The handle is typically threaded into the housing portion 20 in a fluid tight and releasable engagement. The housing portion 20 and support portion 22 can be made of any lightweight material including polymeric plastic or nylon materials, among many other durable lightweight materials known in the art.

A support portion 22 is secured to the discharge side of the housing portion 20. Support portion 22 may be manufactured separately and subsequently secured to the housing portion 20 by any means known in the art. Alternatively, as those skilled in the art appreciate, it is contemplated that support portion 22 may be integrally molded with the housing portion 20 during the manufacturing process.

A washing element 12 is secured, by any means known in the art, to an end of the first portion of the support portion 22. The washing element 12 extends horizontally across and beyond the end of the first portion of the support portion 22. The preferred embodiment includes a liquid distribution means 28 longitudinally enclosed within the washing element 12. This embodiment provides for a uniform distribution of liquid within washing element 12 by means of perforations, thereby allowing a uniform dispensing of liquid within the washing element. The liquid distribution means 28 is in fluid communication with the liquid delivery means 18 generally by means of a tee and interconnecting tubing connected to the discharge side of the liquid delivery means 18.

Washing elements useful in the present invention include, but are not limited to, bristle brushes, natural and synthetic sponges, scrubber pads or cloth materials. Washing elements made of natural and synthetic sponges and cloth materials may optionally be covered with a mesh-like material 26 which are designed to impart greater abrasive characteristics to the washing element. These mesh-like covers are generally made of nylon and other suitable materials known in the art.

A wiping element 14 is secured to the second portion of the support portion 22 and is generally oriented parallel to the washing element 12. The wiping element 14 extends horizontally across the washing element 12. The washing element 12 and the wiping element 14 are disposed in an angular spaced relation to one another, such that, when the washing element 12 is positioned in effective relation to a surface being cleaned, the wiping element 14 is coincidentally positioned in effective relation to the surface. In accordance with this construction, the surface is synchronously washed and wiped in one backward movement. The backward coincidental movement is repeated one width of the wiper below the previous movement until the bottom of the surface is reached and the entire surface is cleaned.

Wiping elements useful in the present invention include, but are not limited to, squeegees and are made of any suitable rubber or leather materials known in the art so long as the material has sufficient stiffness to wipe fluids from surfaces.

Both the washing element and the wiping element are secured to the respective first and second portions of the support portion 22 by any means known in the art. As an alternative, either the washing element or the wiping element, or alternatively, both elements, may be pivotally secured to the respective first and second portions of support portion 22. A pivotal mount can be accomplished by any tension or spring mounting means known in the art. Pivotal mounting is particularly useful in cleaning applications which require cleaning around corners and at edges of surfaces. The pivot mount compensates for any irregularities, such as corners and edges, in the surface being cleaned and maintains the coincidental contact of the washing and wiping elements with the surface. The pivot mount further assures that the synchronized washing and wiping is accomplished in one motion. However, incorporating the pivotal mounting means is not a preferred embodiment due to the cost of production and the deterioration of the pivot means due to exposure to cleaning fluids.

The tubular handle 16 is provided with a manually operated liquid delivery means 18 for delivering liquid to the washing element 12 through the liquid distribution means 28. The washing element 12 is in fluid communication with the liquid distribution means 28, the liquid delivery means 18 and the liquid reservoir in tubular handle 16.

The liquid delivery means 18 can be of any construction known in the art and includes any manually actuated pump apparatus known in the art.

The novel cleaning apparatus of the present invention is generally useful for the coincidental synchronous washing and wiping of surfaces. In particular, the user grasps, with one hand, the apparatus by the tubular handle/liquid reservoir 16. In preparation for use the liquid reservoir is filled with a liquid cleaning solution or water. After filling the reservoir within handle 16, the user delivers the cleaning solution to the washing element 12 by actuating the delivery means 18 until the washing element 12 is sufficiently wet for effective washing of the surface. The user firmly grasps the handle 16 and brings the device into contact with a surface to be cleaned. Upon contact, both the washing 12 and wiping 14 elements are in coincidental contact with the surface. The surface is synchronously washed and wiped by dragging the apparatus backward across the surface being cleaned in a single uniform movement. With the stroke of the device directly below the previous stroke, the washing element 12 reabsorbs the wiped cleaning liquid for subsequent redistribution on the surface to be cleaned thus conserving the cleaning fluid and further wipes the surface thereby producing a clean, dry surface.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A cleaning apparatus comprising:

a hollow elongate tubular handle portion wherein the handle portion is a liquid reservoir;

a housing having a first end and a second end, including a manually operated liquid delivery means within the housing, the housing first end being releasably connected to the handle portion and the manually-operated liquid delivery means being in fluid communication with the liquid reservoir in the handle portion;

a support portion including a first portion and a second portion adjacent the first portion wherein the first and second portions merge to form a Y-shape configuration with a base portion of the support portion, and the base portion of the support portion being secured to the housing second end;

a washing element secured to an end of the first portion of the support portion and extending horizontally across and beyond said end of the first portion wherein the washing element is selected from the group consisting of brushes, natural sponges, synthetic sponges, cloth materials and scrubber pads;

a liquid distribution means longitudinally enclosed within the washing element, the liquid distribution means being in fluid communication with the manually-operated liquid delivery means wherein the liquid distribution means is capable of dispensing fluid in a uniform manner within the washing element; and a wiping element secured to an end of the second portion of the Y-shape support portion and extending horizontally across and beyond said end of the second portion, the wiping element having a length at least as long as the washing element and being secured to said end of the second portion of the Y-shape support portion such that said wiping element is positioned parallel to the washing element, wherein when the washing element is positioned in effective relation to a surface to be cleaned, the wiping element is coincidentally positioned in effective relation to the surface so that washing and wiping can be accomplished in a single synchronized motion.

2. The cleaning apparatus according to claim 1 wherein the washing element is covered with a mesh-like material for enhancing abrasive characteristics.

3. The cleaning apparatus according to claim 2 wherein the mesh-like material is made from a nylon material.

4. The cleaning apparatus according to claim 1 wherein the wiping element comprises a squeegee member.

5. The cleaning apparatus according to claim 4 wherein the squeegee member is made of a material selected from rubber and leather.

* * * * *